US006063751A

United States Patent [19]

France et al.

[11] Patent Number: 6,063,751

[45] Date of Patent: May 16, 2000

[54] PROCESS FOR MAKING A LOW DENSITY DETERGENT COMPOSITION BY AGGLOMERATION FOLLOWED BY DIELECTRIC HEATING

[75] Inventors: Paul Amaat France; Larry Rudolph Genskow, both of West Chester, Ohio; Wayne Edward Beimesch, Covington, Ky.

[73] Assignee: The Procter & Gamble Company, Cincinnati, Ohio

[21] Appl. No.: 09/180,678

[22] PCT Filed: May 1, 1997

[86] PCT No.: PCT/US97/07205

§ 371 Date: Apr. 5, 1999

§ 102(e) Date: Apr. 5, 1999

[87] PCT Pub. No.: WO97/43399

PCT Pub. Date: Nov. 20, 1997

Related U.S. Application Data

[60] Provisional application No. 60/017,667, May 14, 1996.

[51] Int. Cl.[7] ..... C11D 11/00

[52] U.S. Cl. ..... 510/444; 510/457; 34/255; 34/259

[58] Field of Search ..... 510/444, 457; 34/255, 259

[56] References Cited

U.S. PATENT DOCUMENTS

| | | | |
|---|---|---|---|
| 4,078,519 | 3/1978 | Angelico | 118/629 |
| 4,118,333 | 10/1978 | Dugan et al. | 252/135 |
| 4,379,080 | 4/1983 | Murphy | 510/350 |
| 4,715,979 | 12/1987 | Moore et al. | 510/297 |
| 4,900,466 | 2/1990 | Atkinson et al. | 510/443 |
| 4,967,486 | 11/1990 | Doelling | 34/1 |
| 5,162,629 | 11/1992 | Erz et al. | 219/10.81 |
| 5,576,285 | 11/1996 | France et al. | 510/444 |
| 5,585,115 | 12/1996 | Sherwood et al. | 424/489 |
| 5,665,691 | 9/1997 | France et al. | 510/444 |
| 5,668,099 | 9/1997 | Chapman et al. | 510/444 |

FOREIGN PATENT DOCUMENTS

| | | | |
|---|---|---|---|
| 1004876A5 | 2/1993 | Belgium . | |
| 0 653 481 A1 | 5/1995 | European Pat. Off. | C11D 3/12 |
| 2 327 956 | 12/1974 | Germany | C11D 17/06 |

*Primary Examiner*—Lorna M. Douyon

*Attorney, Agent, or Firm*—C. Brant Cook; Kim William Zerby; Jacobus C. Rasser

[57] ABSTRACT

A process for preparing a low density detergent composition is disclosed. The process includes the steps of agglomerating a detergent surfactant paste and dry starting detergent material in a high speed mixer to obtain detergent agglomerates wherein the detergent agglomerates include at least 3% by weight water and dielectrically heating the detergent agglomerates so as to form the detergent composition having a density of below 600 g/l.

16 Claims, No Drawings

PROCESS FOR MAKING A LOW DENSITY DETERGENT COMPOSITION BY AGGLOMERATION FOLLOWED BY DIELECTRIC HEATING

This application claims the benefit of U.S. Provisional Application Ser. No. 60/017,667 filed May 14, 1996.

FIELD OF THE INVENTION

The present invention generally relates to a process for producing a low density detergent composition. More particularly, the invention is directed to a process in which low density detergent agglomerates are produced by feeding a surfactant paste or liquid acid precursor of a surfactant and dry starting detergent material into a high speed mixer. The process produces a free flowing, low density detergent composition which can be commercially sold as a conventional non-compact detergent composition or used as an admix in a low dosage, "compact" detergent product.

BACKGROUND OF THE INVENTION

Recently, there has been considerable interest within the detergent industry for laundry detergents which are "compact" and therefore, have low dosage volumes. To facilitate production of these so-called low dosage detergents, many attempts have been made to produce high bulk density detergents, for example with a density of 600 g/l or higher. The low dosage detergents are currently in high demand as they conserve resources and can be sold in small packages which are more convenient for consumers. However, the extent to which modern detergent products need to be "compact" in nature remains unsettled. In fact, many consumers, especially in developing countries, continue to prefer a higher dosage levels in their respective laundering operations. Consequently, there is a need in the art of producing modern detergent compositions for flexibility in the ultimate density of the final composition.

Generally, there are two primary types of processes by which detergent granules or powders can be prepared. The first type of process involves spray-drying an aqueous detergent slurry in a spray-drying tower to produce highly porous detergent granules. In the second type of process, the various detergent components are dry mixed after which they are agglomerated with a binder such as a nonionic or anionic surfactant. In both processes, the most important factors which govern the density of the resulting detergent granules are the density, porosity and surface area, shape of the various starting materials and their respective chemical composition. These parameters, however, can only be varied within a limited range. Thus, flexibility in the substantial bulk density can only be achieved by additional processing steps which lead to lower density of the detergent granules.

There have been many attempts in the art for providing processes which increase the density of detergent granules or powders. Particular attention has been given to densification of spray-dried granules by post tower treatment. For example, one attempt involves a batch process in which spray-dried or granulated detergent powders containing sodium tripolyphosphate and sodium sulfate are densified and spheronized in a Marumerizer®. This apparatus comprises a substantially horizontal, roughened, rotatable table positioned within and at the base of a substantially vertical, smooth walled cylinder. This process, however, is essentially a batch process and is therefore less suitable for the large scale production of detergent powders. More recently, other attempts have been made to provide continuous processes for increasing the density of "post-tower" or spray dried detergent granules. Typically, such processes require a first apparatus which pulverizes or grinds the granules and a second apparatus which increases the density of the pulverized granules by agglomeration. While these processes achieve the desired increase in density by treating or densifying "post tower" or spray dried granules, they do not provide a process which has the flexibility of providing lower density granules.

Moreover, all of the aforementioned processes are directed primarily for densifying or otherwise processing spray dried granules. Currently, the relative amounts and types of materials subjected to spray drying processes in the production of detergent granules has been limited. For example, it has been difficult to attain high levels of surfactant in the resulting detergent composition, a feature which facilitates production of detergents in a more efficient manner. Thus, it would be desirable to have a process by which detergent compositions can be produced without having the limitations imposed by conventional spray drying techniques.

To that end, the art is also replete with disclosures of processes which entail agglomerating detergent compositions. For example, attempts have been made to agglomerate detergent builders by mixing zeolite and/or layered silicates in a mixer to form free flowing agglomerates. While such attempts suggest that their process can be used to produce detergent agglomerates, they do not provide a mechanism by which a starting detergent materials in the form of surfactant pastes or acid precursors thereof, liquids and dry materials can be effectively agglomerated into crisp, free flowing detergent agglomerates having low densities rather than high densities (i.e. above 600 g/l).

Accordingly, there remains a need in the art to have a process for producing a low density detergent composition in the form of agglomerates directly from starting detergent ingredients. Also, there remains a need for such a process which is more efficient, flexible and economical to facilitate large-scale production of detergents of low as well as high dosage levels.

BACKGROUND ART

The following references are directed to densifying spray-dried granules: Dugan et al, U.S. Pat. No. 4,118,333 (Colgate); Appel et al, U.S. Pat. No. 5,133,924 (Lever); Bortolotti et al, U.S. Pat. No. 5,160,657 (Lever); Johnson et al, British patent No. 1,517,713 (Unilever); and Curtis, European Patent Application 451,894. The following references are directed to producing detergents by agglomeration: Beerse et al, U.S. Pat. No. 5,108,646 (Procter & Gamble); Capeci et al, U.S. Pat. No. 5,366,652 (Procter & Gamble); Capeci et al, U.S. Pat. No. 5,486,303 (Procter & Gamble); Capeci et al, U.S. Pat. No. 5,489,392 (Procter & Gamble); Hollingsworth et al, European Patent Application 351,937 (Unilever); and Swatling et al, U.S. Pat. No. 5,205,958. The following references are directed to surfactant pastes: Aouad et al, WO 93/18123 (Procter & Gamble); Aouad et al, WO 92/18602 (Procter & Gamble); Aouad et al, EP 508,543 (Procter & Gamble); Mueller et al, U.S. Pat. No. 5,152,932; Strauss et al, U.S. Pat. No. 5,080.848 (Procter & Gamble); Ofosu-Asante et al, U.S. Pat. No. 5.066.425 (Procter & Gamble); Jolicoeur et al, U.S. Pat. No. 5,045,238 (Procter & Gamble); and Van Zorn et al, EP 504,986 (Shell).

SUMMARY OF THE INVENTION

The present invention meets the aforementioned needs in the art by providing a process which produces an agglomerated low density (below about 600 g/l) detergent composition directly from starting ingredients. The process employs dielectric heating means, such as a microwave (MW) dryer or a Radio Frequency (RF) dryer, to "puff" agglomerates formed by agglomerating a surfactant paste or acid precursor thereof and dry detergent materials. The process does not use the conventional spray drying towers and is therefore more efficient, economical and flexible with regard to the variety of detergent compositions which can be produced in the process. Moreover, the process is more amenable to environmental concerns in that it does not require spray drying towers which require more energy to operate and may emit particulates and volatile organic compounds into the atmosphere if not operated properly.

As used herein, the term "agglomerates" refers to particles formed by agglomerating detergent granules or particles which typically have a smaller mean particle size than the formed agglomerates. As used herein, the phrase "dielectric or dielectrically heating" refers to the rapid and uniform heating throughout a material that typically is nonconductive by means of a high-frequency electromagnetic field. All percentages used herein are expressed as "percent-by-weight" unless indicated otherwise and all documents cited herein are incorporated herein by reference. All viscosities described herein are measured at 70° C. and at shear rates between about 10 to 50 $sec^{-1}$, preferably at 25 $sec^{-1}$.

In accordance with one aspect of the invention, a process for producing a low density detergent composition is provided. The process comprises: (a) agglomerating a detergent surfactant paste and dry starting detergent material in a high speed mixer to obtain detergent agglomerates, wherein the detergent agglomerates include at least about 3% by weight of water; and (b) dielectrically heating the detergent agglomerates so as to form the detergent composition having a density of below about 600 g/l.

In another aspect of the invention, another process for producing a low density detergent composition is provided. The process comprises: A process for preparing a low density detergent composition comprising the steps of: (a) agglomerating a liquid acid precursor of anionic surfactant and dry starting detergent material in a high speed mixer to obtain detergent agglomerates, wherein the detergent agglomerates include at least about 3% by weight of water; and (b) dielectrically heating the detergent agglomerates so as to form the detergent composition having a density of below about 600 g/l. Also provided are the low density detergent products produced by any one of the process embodiments described herein.

Accordingly, it is an object of the invention to provide a process for producing a low density detergent composition in the form of agglomerates directly from starting detergent ingredients. It is also an object of the invention to provide a process which is more efficient, flexible and economical to facilitate large-scale production of detergents of low as well as high dosage levels. These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENT

The present invention is directed to a process which produces free flowing, low density detergent agglomerates having a density of less than about 600 g/l, preferably less than about 500 g/l. The process produces low density detergent agglomerates from a viscous surfactant paste or a liquid acid precursor of anionic surfactant which is then neutralized with an alkaline inorganic salt, e.g. sodium carbonate, and dry starting detergent ingredients. Generally speaking, the present process is used in the production of normal as opposed to low dosage detergents, whereby the resulting detergent agglomerates can be used as a detergent or as a detergent additive. It should be understood that the process described herein can be continuous or batch depending upon the desired application.

Process

In the first step of the process, starting detergent materials are fed into a high speed mixer for agglomeration. To achieve the desired density of less than about 600 g/l, the agglomeration step is carried forth in a high speed mixer wherein the starting detergent materials are agglomerated after which an optional moderate speed mixer may be used for further agglomeration if necessary. The nature and composition of the entering or starting detergent materials can vary as described in detail hereinafter. Preferably, the mean residence time of the starting detergent materials in the high speed mixer (e.g. Lödige Recycler CB or other similar equipment) is from about 2 to 45 seconds while the residence time in the optional low or moderate speed mixer (e.g. Lödige Recycler KM "Ploughshare" or other similar equipment) is from about 0.5 to 15 minutes.

The starting detergent materials preferably include a highly viscous surfactant paste or a liquid acid precursor of anionic surfactant and dry detergent material, the components of which are described more fully hereinafter. For purposes of facilitating the production of low density or "fluffy" detergent agglomerates, the detergent agglomerates formed in the agglomeration step are subjected to another other essential step in the process involving dielectrically heating or drying the agglomerates. This can be completed in a wide variety of apparatus including but not limited to microwave or Radio Frequency (RF) dryers which can be fluid bed dryers or standard belt dryers, all of which can be commercially purchased from Microdry Corporation (Kentucky) and Radi Frequency Inc. (Massachusetes). Also, it is preferred that the RF dryers should be operated at frequencies in a range from about 10 MHz to about 60 MHz, more preferably from about 35 MHz to about 45 MHz, and most preferably at about 40 MHz. The MW dryers should be operated at frequencies in the range of from about 400 MHz to about 3000 MHz and more preferably from about 850 MHz to about 2500 MHz, with the frequencies of 915 MHz and 2450 MHz being the most preferred. The agglomerates produced preferably have a density of from about 300 g/l to about 500 g/l. The residence time in such MW and RF dryers is preferably foam about 0.1 minutes to about 15 minutes, more preferably from about 0.1 minutes to about 5 minutes.

This heating or drying step enhances the free flowability of the agglomerates and initiates the "fluffed" or "puffed" physical characteristics of the resulting agglomerates, and in effect, lowers the density of the agglomerates. To this end, it is preferable that the detergent agglomerates exiting the high speed mixer (or the optional moderate speed mixer) contain at least about 3%, more preferably at least about 5%, and most preferably from about 5% to about 15%, by weight of water. Optionally, the process may include the step of spraying water in the high speed mixer to insure that the aforementioned water levels are included in the detergent agglomerates. While not intending to be bound by theory, it is believed that during the agglomeration step of the instant process, the water embodied in the agglomerates instantaneously or very quickly evaporates upon being subjected to dielectric heating causing the agglomerates to "puff" into a fluffy, light, low density agglomerate particle. This effect of lowering the density of the detergent agglomerates via the use of dielectric heating is truly unexpected. However, it is critical that the detergent agglomerates formed in the agglomeration step contain at least the aforementioned water levels for the dielectric heating step to have its full unexpected benefit of lowering the density of the agglomerates.

The detergent agglomerates produced by the process preferably have a surfactant level of from about 20% to about 55%, more preferably from about 35% to about 55% and, most preferably from about 45% to about 55%. The intraparticle porosity of the resulting detergent agglomerates produced according to the process of the invention is preferably in a range from about 5% to about 50%, more preferably at about 25%. Optionally, a hydrated salt selected from the group consisting of citric acid, hydrated sulfates, hydrated carbonates, hydrated bicarbonates, borax pentahydrates and mixtures thereof can be included in the agglomeration step to facilitate or enhance the "puffing" of the agglomerates during the dielectric heating step.

In addition, an attribute of dense or densified agglomerates is the relative particle size. The present process typically provides detergent agglomerates having a median particle size of from about 600 microns to about 2000 microns, and more preferably from about 600 microns to about 850 microns. The optional moderate speed mixer can be used to insure build-up to the aforementioned median particle sizes. As used herein, the phrase "median particle size" refers to individual agglomerates and not individual particles or detergent granules. The combination of the above-referenced porosity and particle size results in agglomerates having density values of less than 600 g/l. Such a feature is especially useful in the production of laundry detergents having varying dosage levels as well as other granular compositions such as dishwashing compositions.

Optional Process Steps

In an optional step of the present process, the detergent agglomerates exiting the microwave or RF dryer are further conditioned by additional cooling or drying in similar apparatus as are well known in the art. Another optional process step involves adding a coating agent to improve flowability and/or minimize over agglomeration of the detergent composition in one or more of the following locations of the instant process: (1) the coating agent can be added directly after the microwave or RF dryer; (2) the coating agent may be added directly to the microwave or RF dryer; (3) the coating agent may be added between the microwave or RF dryer and the optional moderate speed mixer; and/or (4) the coating agent may be added directly to the optional moderate speed mixer and the microwave or RF dryer. The coating agent is preferably selected from the group consisting of aluminosilicates, silicates, carbonates and mixtures thereof. The coating agent not only enhances the free flowability of the resulting detergent composition which is desirable by consumers in that it permits easy scooping of detergent during use, but also serves to control agglomeration by preventing or minimizing over agglomeration, especially when added directly to the moderate speed mixer. As those skilled in the art are well aware, over agglomeration can lead to very undesirable flow properties and aesthetics of the final detergent product.

Optionally, the process can comprise the step of spraying an additional binder in one or both of the mixers or dryer. A binder is added for purposes of enhancing agglomeration by providing a "binding" or "sticking" agent for the detergent components. The binder is preferably selected from the group consisting of water, anionic surfactants, nonionic surfactants, polyethylene glycol, polyvinyl pyrrolidone polyacrylates, citric acid and mixtures thereof. Other suitable binder materials including those listed herein are described in Beerse et al, U.S. Pat. No. 5,108,646 (Procter & Gamble Co.), the disclosure of which is incorporated herein by reference.

Other optional steps contemplated by the present process include screening the undersized ("fines") and/or oversized ("overs") detergent agglomerates in a screening apparatus which can take a variety of forms including but not limited to conventional screens chosen for the desired particle size of the finished detergent product. The undersized agglomerates can be recycled back to the high speed mixer and/or the oversized agglomerates can be sized as desired via grinding or similar process. Other optional steps include conditioning of the detergent agglomerates by subjecting the agglomerates to additional drying by way of apparatus discussed previously.

Another optional step of the instant process entails finishing the resulting detergent agglomerates by a variety of processes including spraying and/or admixing other conventional detergent ingredients. For example, the finishing step encompasses spraying perfumes, brighteners and enzymes onto the finished agglomerates to provide a more complete detergent composition. Such techniques and ingredients are well known in the art.

Detergent Surfactant

The detergent surfactant used in the process is preferably in the form of an aqueous viscous paste, although other forms are also contemplated by the invention. This so-called viscous surfactant paste has a viscosity of from about 5,000 cps to about 100,000 cps, more preferably from about 10,000 cps to about 80,000 cps, and contains at least about 10% water, more typically at least about 30% by weight of water. The viscosity is measured at 70° C. and at shear rates of about 10 to 100 $sec^{-1}$. Furthermore, the surfactant paste, if used, preferably comprises a detersive surfactant as described hereinafter in the amounts specified previously and the balance water and other conventional detergent ingredients.

In an alternative embodiment of the process invention, the liquid acid precursor of a surfactant is used during the agglomeration step. This liquid acid precursor will preferably have a viscosity of from about 500 cps to about 100,000 cps. Typically, the liquid acid is a precursor for the an anionic surfactant as described in detail hereinafter.

Generally speaking, the surfactant is selected from anionic, nonionic, zwitterionic, ampholytic and cationic classes and compatible mixtures thereof. Detergent surfactants useful herein are described in U.S. Pat. No. 3.664,961, Norris, issued May 23, 1972, and in U.S. Pat. No. 3,919,678, Laughlin et al., issued Dec. 30, 1975, both of which are incorporated herein by reference. Useful cationic surfactants also include those described in U.S. Pat. No. 4.222,905, Cockrell, issued Sep. 16, 1980, and in U.S. Pat. No. 4,239, 659, Murphy, issued Dec. 16, 1980, both of which are also incorporated herein by reference. Of the surfactants, anionics, cationics, zwitterionics and nonionics are preferred and anionics are most preferred.

Nonlimiting examples of the preferred anionic surfactants useful include the conventional $C_{11}$–$C_{18}$ alkyl benzene sulfonates ("LAS"), primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, unsaturated sulfates such as oleyl sulfate, and the $C_{10}$–$C_{18}$ alkyl alkoxy sulfates ("$AE_xS$"; especially EO 1–5 ethoxy sulfates).

Other exemplary surfactants useful in the invention include and $C_{10}$–$C_{18}$ alkyl alkoxy carboxylates (especially the EO 1–5 ethoxycarboxylates), the $C_{10}$–$C_{18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions.

The $C_{10}$–$C_{18}$ N-alkyl polyhydroxy fatty acid armides can also be used. Typical examples include the $C_{12}$–$C_{18}$ N-methylglucamides. See WO 9.206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

Dry Detergent Material

The dry detergent materials used in the present process may comprise a wide variety of detergent ingredients, but will preferably include an alkaline inorganic salt when the liquid acid precursor of a surfactant is used so as to provide a neutralizing agent in the agglomeration step. The dry detergent material preferably includes a detergent aluminosilicate builder referenced as aluminosilicate ion exchange materials and sodium carbonate. The aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit as high of an exchange rate and capacity as provided by the sodium form. Additionally, the aluminosilicate ion exchange material preferably is in over dried form so as to facilitate production of crisp detergent agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

Preferably, the aluminosilicate ion exchange material has the formula $$Na_z[(AlO_2)_z \cdot (SiO_2)_y]xH_2O$$

wherein z and y are integers of at least 6, the molar ratio of z to y is from about 1 to about 5 and x is from about 10 to about 264. More preferably, the aluminosilicate has the formula $$Na_{12}[(AlO_2)_{12} \cdot (SiO_2)_{12}]xH_2O$$

wherein x is from about 20 to about 30, preferably about 27. These preferred aluminosilicates are available commercially, for example under designations Zeolite A, Zeolite B, Zeolite P, Zeolite MAP and Zeolite X. Alternatively, naturally-occurring or synthetically derived aluminosilicate ion exchange materials suitable for use herein can be made as described in Krummel et al. U.S. Pat. No. 3.985,669, the disclosure of which is incorporated herein by reference.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/gram. Additionally, the instant aluminosilicate ion exchange materials are still furher characterized by their calcium ion exchange rate which is at least about 2 grains $Ca^{++}$/gallon/minute/-gram/gallon, and more preferably in a range from about 2 grains $Ca^{++}$/gallon/minute/-gram/gallon to about 6 grains $Ca^{++}$/gallon/minute/-gram/gallon.

Adjunct Detergent Ingredients

Adjunct detergent ingredients can be included in the process as well and include bleaches, bleach activators, suds boosters or suds suppressors, anti-tarnish and anticorrosion agents, soil suspending agents, soil release agents, germicides, pH adjusting agents, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Other builders can be generally selected from the various water-soluble, alkali metal, ammonium or substituted ammonium phosphates, polyphosphates, phosphonates, polyphosphonates, carbonates, borates, polyhydroxy sulfonates, polyacetates, carboxylates, and polycarboxylates. Preferred are the alkali metal, especially sodium, salts of the above. Preferred for use herein are the phosphates, carbonates, $C_{10-18}$ fatty acids, polycarboxylates, and mixtures thereof. More preferred are sodium tripolyphosphate, tetrasodium pyrophosphate, citrate, tartrate mono- and di-succinates, and mixtures thereof (see below).

In comparison with amorphous sodium silicates, crystalline layered sodium silicates exhibit a clearly increased calcium and magnesium ion exchange capacity. In addition, the layered sodium silicates prefer magnesium ions over calcium ions, a feature necessary to insure that substantially all of the "hardness" is removed from the wash water. These crystalline layered sodium silicates, however, are generally more expensive than amorphous silicates as well as other builders. Accordingly, in order to provide an economically feasible laundry detergent, the proportion of crystalline layered sodium silicates used must be determined judiciously.

The crystalline layered sodium silicates suitable for use herein preferably have the formula $$NaMSi_xO_{2x+1}\cdot yH_2O$$

wherein M is sodium or hydrogen, x is from about 1.9 to about 4 and y is from about 0 to about 20. More preferably, the crystalline layered sodium silicate has the formula $$NaMSi_2O_5\cdot yH_2O$$

wherein M is sodium or hydrogen, and y is from about 0 to about 20. These and other crystalline layered sodium silicates are discussed in Corkill et al, U.S. Pat. No. 4,605,509, previously incorporated herein by reference.

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are tetraborate decahydrate and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylene malonic acid. Some of these materials are useful as the water-soluble anionic polymer as hereinafter described, but only if in intimate admixture with the non-soap anionic surfactant.

Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071 Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

In order to make the present invention more readily understood, reference is made to the following examples, which are intended to be illustrative only and not intended to be limiting in scope.

EXAMPLES I–II

These Examples illustrate one embodiment of the process invention in which a liquid acid precursor of an anionic surfactant is used in the agglomeration step. Specifically, a low density detergent composition is prepared in a batch mode using a lab tilt-a-pin mixer (commercially available from Processall, Inc.). The mixer is first charged with a mixture of dry powders, namely sodium carbonate (median particle size 5–40 microns made via Air Classifier Mill), light density sodium tripolyphosphate (referenced herein as "STPP" and supplied by FMC Corp.), zeolite type A (supplied by Ethyl Corp. and noted herein as "Zeolite A"), sodium bicarbonate (supplied by FMC Corp.) and undersized finished agglomerates having a median particle size of less than 150 microns to mimic the "recycling of such undersized particles during continuous large-scale modes of the current process. A liquid acid precursor of sodium alkylbenzene sulfonate ($C_{12}H_{25}$—$C_6H_4$—$SO_3$—H or "HLAS" as noted below) is then added on top of the powder mixture while the mixer is operated for 15 seconds at 700 rpm, during which discrete detergent agglomerates are formed in the mixer. A 4" diameter prototype fluid bed having a Radio Frequency (RF) heater connected to it is operated at a frequency of 40.7 HMz with an inlet air temperature in the bed of about 150° C. The power supplied by the RF fluid bed dryer is on the order of 250–500 Watts, and the residence time of the agglomerates is about 2 minutes. The amount of agglomerates inputted into the RF fluid bed drier is about 700 g. The moisture (water) is measured in a Mettler moisture balance for 5 minutes at 160° C. The compositions of the agglomerates are set forth in Table I below.

TABLE 1

| Agglomerate Component | I | II |
|---|---|---|
| | (% Weight) | |
| HLAS | 18.3 | 22.1 |
| fine sodium Carbonate | 30.7 | 36.7 |
| STPP | 14.6 | 17.5 |
| Sodium Bicarbonate | 14.6 | — |
| Zeolite A | 16.4 | 7.3 |
| Recycled fines (<150 microns) | 13.7 | 16.4 |
| Moisture (%) | 9.2 | 3.5 |
| | 100.0 | 100.0 |
| Mean Particle Size (microns) | 378 | 496 |
| Bulk Density (g/l) before RF drying | 605 | 606 |
| Bulk Density (g/l) after RF drying | 430 | 574 |

As can be seen from Table I, the densities of the agglomerates produced in Examples I and II unexpectedly are lowered after heating with the RF fluid bed dryer in the instant process invention.

EXAMPLES III–IV

These Examples illustrate another embodiment of the process invention in which an anionic surfactant paste is used in the agglomeration step to produce Example III and a comparative Example IV composition in which the exact process and materials are used except that the median particle size of the agglomerates are outside the preferred 600 microns to 1000 microns range. Specifically, a low density detergent composition is prepared in a batch mode using a Cuisenart™ food processor. The mixer is first charged with a mixture of powders, namely sodium carbonate (median particle size of 5–40 microns made via Air Classifier Mill), light density sodium tripolyphosphate (referenced "STPP" and commercially supplied by FMC Corp.). An aqueous surfactant paste comprising 70% by weight sodium $C_{12-16}$ alkyl sulfate surfactant ("$C_{12-16}$ AS") and 30% water, is then added on top of the powder mixture while the mixer is being operated for 15 seconds at high speed. The surfactant paste is added until discrete agglomerates are formed in the mixer. The agglomerates are then transferred to a microwave fluid bed drier operated at 2450 MHz that is commercially available from Microdry Inc. The microwave fluid bed dryer is fluidized with nitrogen gas at 100° C. with air flow of roughly 1.8 SCFM through a glass column. The power density of the MW used is 1–3 kW for 55 seconds. The following compositions are made as shown in Table II.

TABLE II

| Agglomerate Component | III | IV |
|---|---|---|
| | (% Weight) | |
| $C_{12-16}$AS | 40 | 40 |
| Sodium carbonate | 30 | 30 |
| STPP | 30 | 30 |
| Moisture (%) | 13 | 11 |
| | 100.0 | 100.0 |
| Mean Particle Size (microns) | 750 | 300 |
| Bulk Density (g/l) before microwave drying | 620 | 675 |
| Bulk Density (g/l) after microwave drying | 385 | 610 |

As can be seen from Table II, Example I which is within the scope of the invention in that it produces agglomerates having a particle size within the 600–2000 micron median particle size range has an unexpectedly low density of 385 g/l after being subjected to a microwave fluid bed dryer. By contrast, Example II (outside the invention with a median particle size of 300 microns) did not undergo a significant density reduction, and definitely not below 600 g/l as with the present process invention.

Having thus described the invention in detail, it will be clear to those skilled in the art that various changes may be made without departing from the scope of the invention and the invention is not to be considered limited to what is described in the specification.

What is claimed is:

1. A process for preparing a low density detergent composition comprising the steps of:

(a) agglomerating a detergent surfactant paste and dry starting detergent material selected from the group consisting of aluminosilicates, crystalline layered silicates, carbonates, phosphates, and mixtures thereof in a high speed mixer to obtain detergent agglomerates, wherein said detergent agglomerates include at least about 5% by weight of water; and (b) dielectrically heating said detergent agglomerates so as to form said detergent composition having a density of from about 300 g/l to about 500 g/l and a median particle size of from about 750 microns to about 2000 microns.

2. A process according to claim 1 wherein the density of said detergent composition is less than about 500 g/l.

3. A process according to claim 1 wherein said detergent agglomerates comprise at least about 10% by weight of water.

4. A process according to claim 1 wherein said agglomerating step includes the step of spraying water into said high speed mixer/densifier to produce said detergent agglomerates having at least about 5% of water.

5. A process according to claim 1 further comprising the step of agglomerating said detergent agglomerates in a moderate speed mixer after said high speed mixer.

6. A process according to claim 1 wherein said dielectrically heating step is conducted in a Radio Frequency dryer operated at a frequency of from about 10 MHz to about 60 MHz.

7. A process according to claim 6 wherein the residence time of said detergent agglomerates in said Radio Frequency dryer is from about 0.1 minutes to about 5 minutes.

8. A process according to claim 1 wherein said dielectrically heating step is conducted in a microwave dryer operated at a frequency of from about 850 MHz to about 2500 MHz.

9. A process according to claim 8 wherein the residence time of said detergent agglomerates in said microwave dryer is from about 0.1 minutes to about 5 minutes.

10. A process for preparing a low density detergent composition comprising the steps of:

(a) agglomerating a liquid acid precursor of anionic surfactant and dry starting detergent material selected from the group consisting of aluminosilicates, crystalline layered silicates, carbonates, phosphates, and mixtures thereof in a high speed mixer to obtain detergent agglomerates, wherein said detergent agglomerates include at least about 5% by weight of water; and (b) dielectrically heating said detergent agglomerates so as to form said detergent composition having a density of below about from about 300 g/l to about 500 g/l and a median particle size of from about 750 microns to about 2000 microns.

11. A process according to claim 10 wherein said dielectrically heating step is conducted in a Radio Frequency dryer operated at a frequency of from about 10 MHz to about 60 MHz.

12. A process according to claim 11 wherein the residence time of said detergent agglomerates in said Radio Frequency dryer is from about 1 minute to about 5 minutes.

13. A process according to claim 10 wherein said dielectrically heating step is conducted in a microwave dryer operated at a frequency of from about 850 MHz to about 2500 MHz.

14. A process according to claim 13 wherein the residence time of said detergent agglomerates in said microwave dryer is from about 0.1 minutes to about 5 minutes.

15. A process according to claim 10 wherein said agglomerating step includes the step of spraying water into said high speed mixer/densifier to produce said detergent agglomerates having at least about 5% of water.

16. A process according to claim 10 further comprising the step of agglomerating said detergent agglomerates in a moderate speed mixer after said high speed mixer.

* * * * *